US009382885B2

(12) United States Patent
Agresta et al.

(10) Patent No.: US 9,382,885 B2
(45) Date of Patent: Jul. 5, 2016

(54) FUEL INJECTION VALVE FOR AN INTERNAL COMBUSTION ENGINE

(71) Applicant: Continental Automotive GmbH, Hannover (DE)

(72) Inventors: Antonio Agresta, Pisa (IT); Luigi Gargiulo, Pisa (IT); Marco Mechi, Vada (IT); Salvatore Varchetta, Ponsacco (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 14/598,504

(22) Filed: Jan. 16, 2015

(65) Prior Publication Data

US 2015/0204289 A1 Jul. 23, 2015

(30) Foreign Application Priority Data

Jan. 17, 2014 (EP) ..... 14151658

(51) Int. Cl.
*F02M 51/06* (2006.01)

(52) U.S. Cl.
CPC ..... *F02M 51/0625* (2013.01); *F02M 51/066* (2013.01); *F02M 51/0685* (2013.01)

(58) Field of Classification Search
CPC ..... F02M 51/0625; F02M 51/066; F02M 51/0685; F02M 51/061; F02M 51/0614; F02M 59/46; F02M 59/466; F02M 63/0012; F02M 63/0017; F02M 63/0021; F02M 63/0024; F02M 63/0031; F02M 61/10
USPC ..... 123/472, 477, 478; 239/585.1; 251/129.15, 129.21
See application file for complete search history.

(56) References Cited

U.S. PATENT DOCUMENTS 5,694,903 A 12/1997 Ganser ..... 123/496
6,450,424 B1 * 9/2002 Horbelt ..... F02M 51/0625 239/583

(Continued)

FOREIGN PATENT DOCUMENTS

DE 19948238 A1 4/2001 ..... F02M 51/06
DE 10113008 A1 5/2002 ..... F02M 47/02

(Continued)

OTHER PUBLICATIONS

U.S. Advisory Action, U.S. Appl. No. 13/880,726, 3 pages, Nov. 3, 2015.

(Continued)

*Primary Examiner* — Grant Moubry
(74) *Attorney, Agent, or Firm* — Slayden Grubert Beard PLLC

(57) ABSTRACT

A fuel injection valve for an internal combustion engine includes a movable armature including first and second armature parts, and a magnetic coil that generates a magnetic field for effecting an axial travel of the armature to displace a valve needle away from a closing position. During a first period of axial travel, the second armature part is axially displaced while the valve needle remains closed. During a subsequent second period of the axial travel, the first and second armature parts and the valve needle are fixed with respect to each other and travel axially with respect to the housing. During a third period of the travel, only the first armature part travels further towards the pole element for moving the valve needle further away from the closing position and the axial travel of the first armature part is subsequently stopped at the end of the third period.

17 Claims, 15 Drawing Sheets

(56) References Cited

U.S. PATENT DOCUMENTS

| | | | | |
|---|---|---|---|---|
| 6,510,841 | B1 * | 1/2003 | Stier | F02M 51/0625 123/472 |
| 6,520,434 | B1 * | 2/2003 | Reiter | F02M 51/0685 239/533.11 |
| 6,796,543 | B2 | 9/2004 | Haeberer et al. | 251/50 |
| 6,808,133 | B1 * | 10/2004 | Stier | F02M 51/0614 239/585.1 |
| 8,931,718 | B2 * | 1/2015 | Grandi | F02M 51/066 239/585.4 |
| 2003/0019959 | A1 | 1/2003 | Brenk et al. | 239/585.5 |
| 2003/0029941 | A1 | 2/2003 | Keim | 239/585.1 |
| 2003/0116657 | A1 | 6/2003 | Nakayama et al. | 239/585.1 |
| 2004/0050977 | A1 * | 3/2004 | Rieger | F02M 51/0685 239/585.1 |
| 2008/0277505 | A1 | 11/2008 | Hoang | 239/585.5 |
| 2012/0080542 | A1 | 4/2012 | Imai | 539/533.2 |
| 2013/0299611 | A1 * | 11/2013 | Lyubar | F02M 51/0625 239/585.5 |

FOREIGN PATENT DOCUMENTS

| | | | | |
|---|---|---|---|---|
| DE | 10332812 | A1 | 2/2005 | F02M 51/06 |
| EP | 1137877 | B1 | 8/2004 | F02M 51/06 |
| EP | 1801409 | A1 | 6/2007 | F02M 51/06 |
| EP | 2138705 | A1 | 12/2009 | F02M 47/02 |
| EP | 2236807 | A1 | 10/2010 | F02M 51/06 |
| EP | 2444651 | A1 | 4/2012 | F02M 51/06 |
| JP | 2002310029 | A | 10/2002 | F02M 51/06 |
| WO | 2012/052364 | A1 | 4/2012 | F02M 51/06 |

OTHER PUBLICATIONS

European Search Report, Application No. 14151658.3, 7 pages, May 13, 2014.

U.S. Notice of Allowance, U.S. Appl. No. 13/880,726, 10 pages, Feb. 10, 2016.

European Search Report, Application No. 10188087.0, 4 pages, Mar. 30, 2011.

International Search Report and Written Opinion, Application No. PCT/EP2011/068005, 10 pages, Nov. 8, 2011.

* cited by examiner

Prior Art

FUEL INJECTION VALVE FOR AN INTERNAL COMBUSTION ENGINE

CROSS-REFERENCE TO RELATED APPLICATIONS

This application claims priority to EP Patent Application No. 14151658 filed Jan. 17, 2014. The contents of which are incorporated herein by reference in their entirety.

TECHNICAL FIELD

The disclosure relates to a fuel injection valve for an internal combustion engine.

BACKGROUND

Fuel injection valves which operate electromagnetically are well known. With the aid of a magnetic coil which is chargeable by electricity to generate a magnetic field, a magnetisable armature, which may be combined with a valve needle, will be stimulated for movement. Normally, the movement is an axial movement along a valve needle axis of the valve needle.

If the valve needle and the armature are coupled, the valve needle also starts moving due to the movement of the armature. Depending on the direction of the movement, a nozzle orifice may be opened or closed with the aid of the valve needle. In order to seal the nozzle orifice when the magnetic coil is not energized, a first spring element is normally positioned in the fuel injection valve, which urges the valve needle against the nozzle orifice. This means, that the valve needle has to be moved by the aid of the armature against the spring force of the first spring element, when the nozzle orifice is to be opened. When the nozzle orifice is open, a fuel quantity, positioned in the fuel injection valve, can flow through the nozzle orifice into a combustion chamber, normally a combustion chamber of an internal combustion engine.

A combustion process of the internal combustion engine depends—among several other criteria, e.g. fuel quantity or fuel temperature or fuel pressure—on the opening and closing transients of the nozzle orifice. Therefore, an exactly defined opening and closing of the nozzle orifice are very important for reaching an advantageous power rate, fuel consumption and/or emissions of the internal combustion engine.

European patent EP 1 137 877 B1 discloses an exemplary fuel injection valve. The fuel injection valve has an armature which is formed by two pieces. So the armature comprises a first armature part and a second armature part.

One problem of the fuel injection valves in the state of the art is a non-linearity of a fuel injection rate depending on a pulse width of the nozzle orifice. Linearity of the fuel injection rate may be achieved only with greater pulse width.

SUMMARY

One embodiment provides a fuel injection valve for an internal combustion engine, comprising: a housing, a valve needle with a needle axis being movably positioned in the housing, a first spring element for biasing the valve needle towards a closing position for sealing a nozzle orifice of the fuel injection valve, a movable armature, which is movable along the needle axis and operable to interact with the valve needle for displacing the valve needle away from the closing position against the bias of the first spring element, wherein the armature comprises a first armature part and a second armature part, wherein the first armature part and the second armature part laterally enclose the valve needle at least in places, a pole element, which is immovably arranged in the housing, and which is operable to limit the movement of the armature, and a magnetic coil which is at least partially enclosing the housing and is operable to generate a magnetic field for effecting an axial travel of the armature towards the pole element for displacing the valve needle away from the closing position, wherein, during a first period of the axial travel, at least the second armature part is axially displaced with respect to the valve needle while the valve needle remains in the closing position, the axial displacement being limited so that the second armature part is operable to engage with the valve needle at the end of the first period for displacing the valve needle away from the closing position, wherein during a subsequent second period of the axial travel, the first armature part, the second armature part and the valve needle are positionally fix with respect to each other and travel axially with respect to the housing (2), and wherein the axial travel of the second armature part is stopped at the end of the second period by means of interaction with the pole element, so that during a subsequent third period of the travel, only the first armature part travels further towards the pole element for moving the valve needle further away from the closing position and the axial travel of the first armature part is subsequently stopped at the end of the third period by means of interaction with the pole element.

In a further embodiment, the first armature part is rigidly fixed to the valve needle or is in form fit engagement with the valve needle at least during the second and third period of the travel of the armature.

In a further embodiment, a stopper is provided between the pole element and the armature for stopping the axial travel of the second armature part at the end of the second period of the travel of the armature.

In a further embodiment, the stopper is surrounding the first armature part and the stopper is in particular annularly shaped.

In a further embodiment, the stopper has a first contact surface of which faces toward the armature, and the second armature part has a second contact surface which faces toward the first contact surface and is in contact with the first contact surface when the stopper stops the axial travel of the second armature part, the first contact surface having a smaller area than the second contact surface.

In a further embodiment, the pole element comprises a recess for accommodating at least a portion of the first armature part.

In a further embodiment, the valve needle is formed with a constriction.

In a further embodiment, one of the armature parts is accommodated in a recess which is provided in the other armature part.

In a further embodiment, a second spring element is provided in the housing for biasing the second armature part away from the pole element.

In a further embodiment, the second spring element is be positioned between the armature and the pole element.

In a further embodiment, the pole element comprises a recess for accommodating the second spring element.

In a further embodiment, the second spring element is positioned between the first armature part and the second armature part.

In a further embodiment, the second spring element is accommodate in a recess which is provided in the first armature part or the second armature part.

In a further embodiment, the second spring element is a an undulated washer or a wave spring.

In a further embodiment, a non-magnetic element, in particular a non-magnetic ring, is provided between the first armature part and the second armature part.

BRIEF DESCRIPTION OF THE DRAWINGS

Example embodiments are described in detail below with reference to the figures, in which.

DETAILED DESCRIPTION

Figure 1:
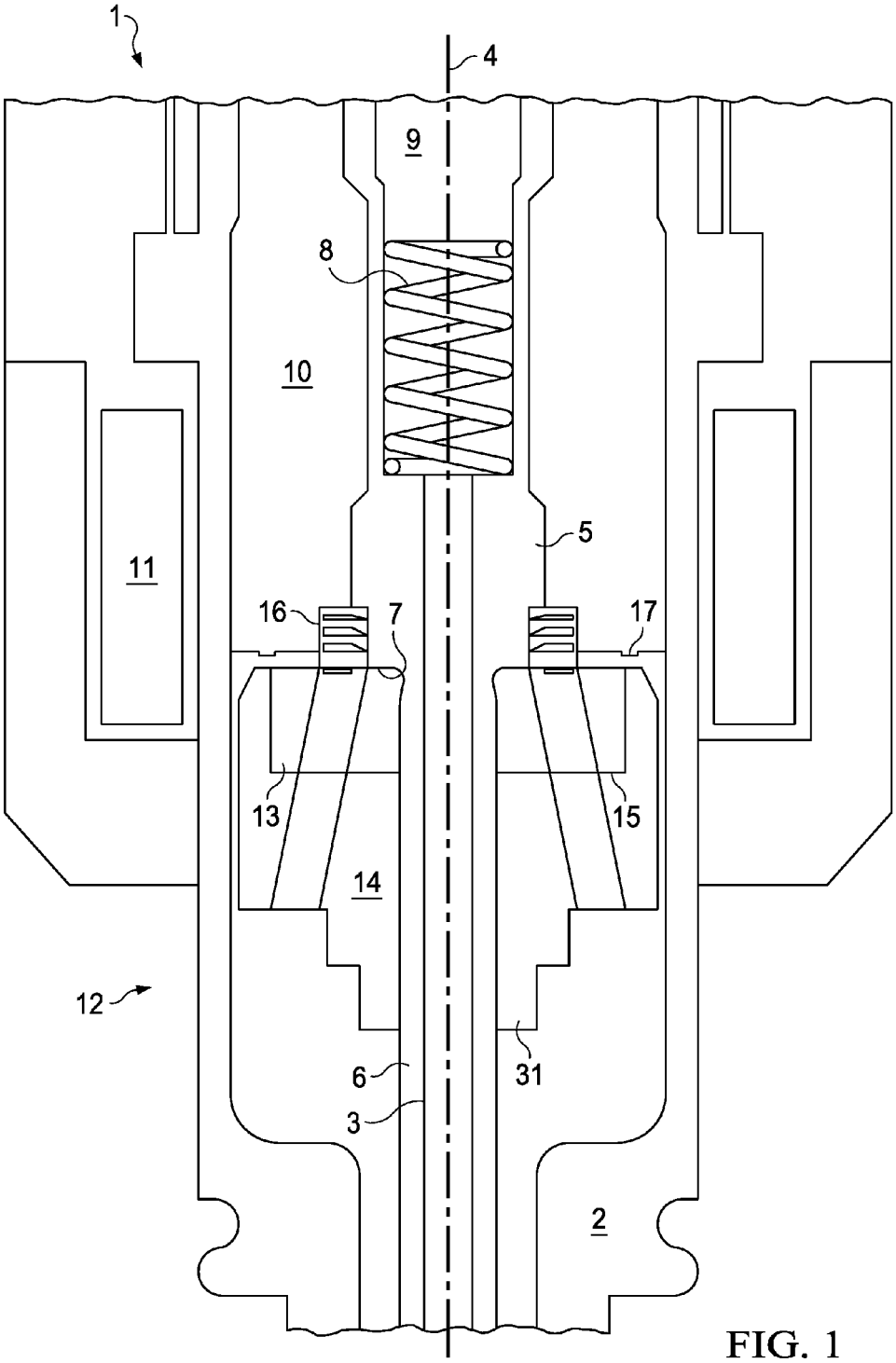
FIG. 1 is a longitudinal sectional view of a cut-out of a first exemplary embodiment of the fuel injection valve.

Embodiments of the invention provide a fuel injection valve which has an improved linearity.

A fuel injection valve for an internal combustion engine is specified. The fuel injection valve may be provided for a fuel injection device of the internal combustion engine.

The fuel injection valve comprises a housing, a valve needle, a first spring element, a movable armature, a pole element and a magnetic coil.

The valve needle has a needle axis and is movably positioned in the housing, in particular a in a cavity of the housing which hydraulically connects a fuel inlet of the fuel injection valve to a nozzle of the fuel injection valve. The needle axis may coincide with a longitudinal axis of the housing.

The first spring element is provided for biasing the valve needle towards a closing position for sealing a nozzle orifice of the fuel injection valve. Expediently, the valve needle is axially displaceable away from the closing position of unsealing the orifice.

The movable armature is movable in reciprocating fashion along the needle axis with respect to the housing. The armature is operable to interact with the valve needle for displacing the valve needle away from the closing position against the bias of the first spring element. The armature comprises a first armature part and a second armature part, which are axially displaceable with respect to one another. The first armature part and the second armature part laterally enclose the valve needle at least in places.

The pole element is unmovably positioned in the housing. For example it is fixed to the housing or in one piece with the housing. The pole element is operable limit the movement of the armature. It is in particular part of a magnetic circuit which further comprises the coil and the movable armature.

The magnetic coil is enclosing the housing at least partially. It is operable to generate a magnetic field for effecting an axial travel of the armature towards the pole element for displacing the valve needle away from the closing position.

During a first period of the axial travel, at least the second armature part is axially displaced with respect to the valve needle while the valve needle remains in the closing position. In a first development, both the first and second armature parts are axially displaceable with respect to the valve needle and are axially displaced with respect to the latter during the first period. In a second development, the first armature part is positionally fix with respect to the valve needle—in particular it is rigidly fixed to the valve needle—and only the second armature part is axially displaced with respect to the valve needle during the first period.

The axial displacement is limited so that the second armature part is operable—or both, the first and second armature parts in case of the first development are operable—to engage with the valve needle at the end of the first period for displacing the valve needle away from the closing position. Engagement of the second armature part with the valve needle may be via the first armature part for example, e.g. by means of the second armature part coming into a form-fit engagement with the second armature part. For example in case of the first development, the second armature part may come into form-fit engagement with the valve needle, in particular with an armature retainer of the valve needle.

For reaching linearity of a fuel injection rate, it is advantageous that in the beginning of the movement of the valve needle, the so-called valve needle lift, large forces are active. These are necessary because of the dead weight of valve needle and the dead weight of the armature, which both have to be lifted. Also a spring force of the first spring element has to be overcome. Injection fuel devices of Common Rail systems are working at high pressures rates. For moving the valve needle, the high pressure also may have to be overcome, at least in the case of so-called inward-opening injection valves. The free lift of the second armature part or the first and second armature parts during the first period advantageously may generate a particularly large impulse on the valve needle at the end of the first period and thus contributes to achieving a good linear behaviour of the fuel injection valve.

During a subsequent second period of the axial travel, the first armature part, the second armature part and the valve needle are positionally fix with respect to each other and travel axially with respect to the housing. In particular, the armature forces the valve needle to move out of and away from the closing position by means of force transfer to the valve needle via the above mentioned form-fit engagements. The second period of the axial travel may also be called "ballistic phase".

Advantageously, both parts are acting on the valve needle until the end of the ballistic phase is reached. A particularly good force transfer—and thus e.g. a particularly fast opening, good reproducability and/or stable movement—is achievable by means of the positionally fixed configuration of the first armature part, the second armature part and the valve needle during the second period.

The axial travel of the second armature part is stopped at the end of the second period—in particular by means of interaction with the pole element—so that, during a subsequent third period of the travel, only the first armature part travels further towards the pole element for moving the valve needle further away from the closing position. The axial travel of the first armature part may preferably be subsequently stopped at the end of the third period, in particular by means of interaction with the pole element. In case of the above mentioned second development, the first armature part is in form fit engagement with the valve needle at least during the second and third period of the travel of the armature. The valve needle and the first armature part move relative to the second armature part and to the housing during the third period.

After the ballistic phase, there are only low magnetic forces needed for reaching the maximum lift of the valve needle. Also a positioning of the valve needle, during a constant lift may be obtained by low magnetic forces.

The advantage of the decoupling of the first armature part from the second armature part is a reduction in inertia which impacts on the pole element when the maximum needle lift is reached. If the armature was not divided into two parts, the armature with its whole mass would bounce against the pole element all at the same time which would cause disadvantageous vibrations of the valve needle during reaching its maximum needle lift. This is an effect which also, besides improving linearity, should be decreased.

Since the first armature part and the second armature part are movable relative to one another and the second armature part is stopped by the pole element before the first armature part comes into contact with the pole element, only the first armature part bounces against the pole element at the time when the valve needle reaches the maximum needle lift. In addition, the magnetic force is reduced during the third period since only the first armature part acts on the valve needle. Therefore, the impact of the first armature part on the pole element may happen with a particularly small velocity due to the balance between the decreased magnetic force and the external force by the first spring element. Because of the reduced velocity and the reduced force, which the pole element has to damp during each impact, the vibrations may be advantageously small.

In other words, with the fuel injection valve according to the present disclosure, linearity may be improved by reducing and controlling an impact velocity between the armature and the pole element. By using the two-parts armature configuration according to the present disclosure, it is possible to obtain a high magnetic force during the ballistic phase and to reduce the magnetic force when it is not needed during the last phase of the valve needle lift so that an impact energy between armature and pole element is decreased.

In one embodiment, one of both armature parts is limited in its movement relative the other armature part. In other words, one of both parts may have smally axial play than the other part.

This may be achieved by a decoupling arrangement, which is provided, for example, between the pole element and the armature, and which may be operable to decouple the first armature part and the second armature part during the third period of the axial travel of the armature, after the second period of the needle lift.

In one embodiment, for decoupling the first armature part and the second armature part a stopper is provided between the pole element and the armature. In other words, the stopper is provided between the pole element and the armature for stopping the axial travel of the second armature part at the end of the second period of the travel of the armature. The stopper is in particular an element which is positionally fix with respect to the pole element or in one piece with the pole element. In one embodiment, the stopper is a protrusion of a surface of the pole element which surface faces towards the armature.

Alternatively, the stopper can be positionally fix with respect to the second armature part or in one piece with the second armature part. In one embodiment, the stopper is represented by a top portion of the second armature part which faces towards the pole element. The top portion in particular protrudes axially beyond the first armature part towards the pole piece during the second period of the axial travel of the armature.

When the second armature part establishes a form-fit connection with the stopper or, when the stopper is positionally fix with respect to the second armature part, the stopper establishes a form-fit connection with the pole element, the stopper will prevent a further axial travel of the second armature part. Only the first armature part, which is expediently not limited by the stopper, may continue moving. The first armature part, which is not limited by the stopper, may have a lift partially independent from the second armature part, which is limited by the stopper.

So when the first armature part and the second armature part are decoupled and the second armature part is stopped by the stopper relative to the first armature part, only the first armature part bounces against the pole element at the time when the valve needle reaches the maximum needle lift. Because of the reduced weight and thus the reduced force, which the pole element has to damp, the vibrations are significantly reduced.

In one embodiment of the fuel injection valve, the first armature part or the second armature part will be limited by the stopper during its axial movement towards the pole element. The first armature part and the second armature part may be thereby decoupled in a simple way during the opening transient by means of stopping one of the parts, so that only the other, non-stopped part is able to move the valve needle completely to the maximum needle lift position.

Preferably, the stopper is surrounding the first armature part. In particular, the stopper exposes the first armature part in top view along the needle axis. This ensures that the stopper only is operable to stop the axial travel of the second armature part without interacting with the first armature part.

In a further embodiment, the stopper is annularly shaped. When, for example, the stopper is manufactured independently of the pole element, it is possible to use a low-cost stopper in form of a ring, which can be mounted to the pole element in form-fit, force-fit or material bounded manner.

When the stopper is manufactured integrally with the pole element as one piece, an economic milling process can be used to shape the stopper.

In a further embodiment of the fuel injection valve, the pole element has a recess for accommodating at least a portion of the first armature part. In this way, a particularly small axial dimension of the fuel injection valve is achievable.

The first armature part may be positioned partly or completely in the recess of the pole element at least at the end of the third period of the axial travel of the armature. With this embodiment, a fuel injection valve with linear performance and compact design is achievable in a simple way.

In one embodiment, the stopper has a first contact surface and the second armature part has a second contact surface. The first contact surface faces towards the armature and the second contact surface faces towards the first contact surface. The second contact surface is in contact with the first contact surface when the stopper stops the axial travel of the second armature part. The first contact surface of the stopper has a smaller area than the second contact area of the armature. In this way, the decoupling between the second armature part and the pole element may be facilitated. An effective contact area between the stopper and the armature is at the most so large as the area of the first contact surface. This advantageous embodiment solves the problem that a decoupling of the pole element and the armature may be hindered by a so-called "sticking-effect", which couples both pieces temporarily by adhesion. Even a complete cancellation of the magnetic field would not promote the decoupling process. Therefore, the end of the fuel injection may be inadvertently delayed. The smaller the effective contact area, the quicker the armature and the pole element can be decoupled. Therefore, the closing time of the nozzle orifice and thus the end of the fuel injection can be determined particularly exactly.

Preferably, the valve needle is formed with a constriction in the area of the first armature part. This also means that the valve needle has a constriction in a second valve needle portion, next to a first valve needle portion.

In one embodiment, the fuel injection valve comprises a second spring element for biasing the second armature part away from the pole element. The second spring element in particular secures a position of the second armature part, or the first and second armature parts, respectively, which otherwise could move along the needle axis while the magnetic coil is not energized. With advantage, a reproducible free lift of the second armature part during the first period of the axial travel of the armature is achievable in this way.

In one embodiment, the second spring element is positioned between the armature and the pole element. In one development, the second spring element extends between a spring seat on the pole element and a spring seat on the first armature part. In this case, the second spring element is operable to bias the first armature part in axial direction away from the pole element. The first armature part may expediently be operable to transfer the spring force of the second spring element to the second armature part for biasing the latter away from the pole element. In this way, a coupling—in particular a form-fit coupling—may be established between the first armature part and the second armature part by means of a second spring element. Preferably, the second spring element secures said coupling between the first armature part and the second armature part during the first and second periods of the axial travel of the armature.

To realise a compact construction, the pole element and/or the first armature part may comprise a recess for the second spring element in one embodiment. In a further advantageous embodiment, the second spring element is designed as an undulated washer or as a wave spring. This is advantageous in that this spring form has a particularly long lifetime under dynamic load and also while having little space requirements, this spring form can absorb high forces.

In another embodiment of the fuel injection valve, the first armature part may be completely positioned in a recess of the second armature part. The second armature part is surrounding the first armature part in axial and in radial direction. The second armature is therefore preferably larger and heavier than the first armature part. The first armature part is expediently configured such that the necessary magnetic force for moving the valve needle during the third period of the axial travel of the armature may be achieved by the first armature part alone. It is therefore advantageous to stop the second armature part by means of the stopper.

In another embodiment of the fuel injection valve, the second spring element is provided between the first armature part and the second armature part. Preferably, the first armature part is fixed to the valve needle or in one piece with the valve needle in this embodiment. The second spring element may in particular be configured to bias the first and second armature parts in opposite axial directions. With advantage, the armature parts are not in contact with one another when the magnetic coil is not energized and the valve needle is in the closing position. This means that, during the first period of the axial travel of the armature, only the second armature part has to move. So the energy for initiating the magnetic field can be reduced in the first period.

Preferably, the spring constant of the second spring element is set such that the sum of the hydraulic force on the valve needle and the spring force of the first spring element is larger than the sum of the spring force of the second spring element and the magnetic force on the first armature part when the valve needle is in the closing position. In this way, the valve needle advantageously remains in the closing position during the first period of the axial travel of the armature. In addition, the spring constant of the second spring is preferably set such that the sum of the spring force of the second spring element and the magnetic force on the first armature part is larger than the spring force of the first spring element during the third period of the axial travel.

In one development, the second spring element is accommodated in a recess which is provided in the first armature part or the second armature part. For example, it is positioned in an extension of the recess of the second armature part in which the first armature part is arranged. With this embodiment, a fuel injection valve with linear performance and compact design is provided in a simple way.

For avoiding impact wear between the first armature part and the second armature part, a non-magnetic mean may be provided between the first armature part and the second armature part. Advantageously, the non-magnetic mean may be a non-magnetic ring. This means, that the non-magnetic mean is annularly shaped. Therefore it can be manufactured in a low-cost way.

FIG. 1 shows a first exemplary embodiment of a fuel injection valve 1 of a fuel injection device for an internal combustion engine according to the invention. The fuel injection valve 1 comprises a housing 2, in which a valve needle 3 with a needle axis 4 is movably arranged. The valve needle axis 4 is also a central longitudinal axis of the housing 2.

The valve needle 3 is hollow-cylindrically shaped and has a first valve needle portion 5 and a second valve needle portion 6, downstream of the first valve needle portion 5. The first valve needle portion 5 has a diameter, which is larger than the diameter of the second valve needle portion 6 so that the first valve needle portion 5 has a support area 7 which is positioned adjacent to the second valve needle portion 6. For example, the first valve needle portion 5 comprises a retainer element 32 which is fixed to a shaft of the valve needle 3 and extends circumferentially around the shaft. Alternatively, the first valve needle portion may comprise a collar which is integrally formed with the shaft of the valve needle.

The fuel injection valve 1 also comprises a first spring element 8 which may be arranged in the area of the first valve needle portion 5. In particular, the first valve needle portion 5 comprises a spring seat for the first spring element, preferably at its side remote from the second valve needle portion, i.e. remote from the support area 7. A calibration element 9 having a second spring seat for the first calibration spring 8 is placed opposite to the first valve needle portion 5, so that the first spring element 8 is elastic movable between the first needle portion 5 and the calibration element 9. The calibration element 9 is positionally fix with respect to the housing during operation of the fuel injection valve 1, for example by means of a friction fit.

A pole element 10 is immovably placed in the housing 2. The first spring element 8 and the first valve needle portion 5 are positioned in a central cavity of the pole element 10.

Adjacent to the housing 2, a magnetic coil 11 is positioned in the region of the pole element 10. The magnetic coil 11 is operable to generate a magnetic field when an electric current is applied to the magnetic coil 11.

An armature 12, which at least partially surrounds the second valve needle portion 6 laterally, is arranged moveably along the needle valve axis 4 in the housing 2. The armature 12 comprises two parts, a first armature part 13 and a second armature part 14. The first armature part 13 may be completely accommodated in a first recess 15 of the second armature part 14.

The axial displacement of the first armature part 13 with respect to the valve needle 3 in direction towards the calibration element 9 is limited by the first valve needle portion 5, in particular by means of a form-fit engagement between the support area 7 and the first armature part 13. The axial displacement of the second armature part 14 with respect to the valve needle 3 in direction away from the calibration element 9 is limited by a disc element 31 which is fixed to the valve needle 3 on a side of the armature 12 remote from the first valve needle portion 5.

The first and second armature parts 13, 14 overlap one another laterally and are arranged such that axial displacement of both armature parts 13, 14 is thereby limited in both axial directions. For example, the first recess 15 extends into the second armature part 14 from its side facing towards the first valve needle portion 5.

The valve needle 3 is formed with a constriction in an interface area of the second valve needle portion 6 with the first valve needle portion 5. In this way, a ring-shaped fluid reservoir may be formed, for example to facilitate a quick establishment and release of the form-fit connection between the first armature part 13 and the support area 7, in particular by means of reducing a hydraulic sticking effect.

The valve needle 3 is biased towards a closing position by the first spring 8 for sealing a nozzle orifice (not shown in the figures) of the fuel injection valve 1. Preferably, a sealing element of the valve needle 3—which is arranged at an axial end of the valve needle 3 opposite of the first valve needle portion 5—rests on a valve seat of the fuel injection valve 1 when the valve needle 3 is in the closing position.

The fuel injection valve 1 has a second spring element 16 which is seated against the pole element 10 on one side and against the armature 12 on the axially opposite side. The second spring element 16 surrounds the valve needle 3 and is arranged in the housing 2 between the pole element 10 and the first armature part 13. The second spring element biases the first armature part 13 in axial direction away from the pole element 10 into the first recess 15 of the second armature part 14.

The second spring element 16 is positioned between the first armature part 13 and the pole element 10. The pole element 10 provides a third recess 22 for accommodating the second spring element 16. The spring element 16 is designed as an undulated washer in order to have a high capacity while requiring little installation space.

The pole element 10 and the armature 12 represent a fixed core and a movable core, respectively, for guiding the magnetic field generated by the coil 11. Upon the generation of a magnetic field by the magnetic coil 11, the armature 12 moves in the direction towards the pole element 10 because of its magnetizability in a fashion further detailed below. Due to a form-fit engagement between the armature 12 and the valve needle 3 at the support area 7, the armature 12 takes the valve needle 3 with it to move axially in the direction of the calibration element 9, thereby compressing the first spring element 8.

This movement displaces the valve needle 3 away from the closing position and, thus, causes an opening of a nozzle orifice of the fuel injection valve 1, through which fuel is dispensed from the housing 2, in particular at high pressure.

Because the opening of the nozzle orifice cannot be realised in an infinitesimally short time, the opening can be divided into various time periods.

Figure 2:
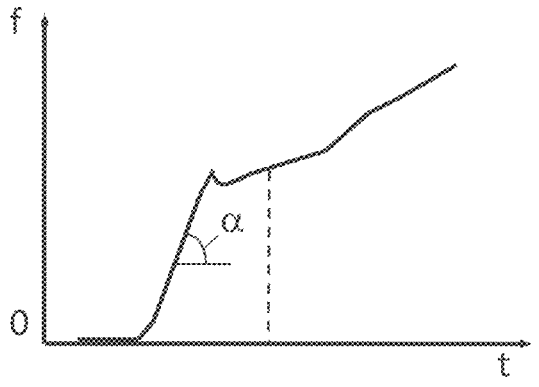
FIG. 2 is a fuel-time-diagram of a fuel injection curve of a fuel injection valve according to the state of the art.

FIG. 2 represents a fuel-time diagram of a fuel injection curve of a fuel injection valve according to the state of the art for one injection event. In a first time period, the curve of the dispensed fuel flow f has a higher inclination than in a second period. This inclination in the first period should decrease; this means in the best case the inclination in both periods should be the same. This is very important regarding an engine performance of the internal combustion engine and also very important for the control characteristics of a control unit of the internal combustion engine.

Figure 3:
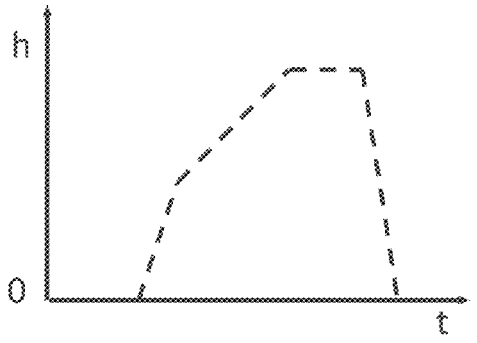
Fig. 3 Prior Art
FIG. 3 is a lift-time diagram of an exemplary lift curve of a fuel injection valve according to the state of the art.

FIG. 3 represents a lift-time diagram of an exemplary lift curve of a fuel injection valve according to the state of the art for one injection event. In the first phase of the fuel injection process higher magnetic forces are needed than in the second phase following to the first phase. It should be noted in this context that all units in the represent diagrams are arbitrary.

The function of the fuel injection valve 1 according to the first exemplary embodiment is explained in detail below.

For the explanation of the fuel injection valves 1 according to the first embodiment, different positions of the armature 12 in relation to the valve needle 3 will be presented in the following FIGS. 4, 6, 8 and 10. For abetter understanding, generally identical diagrams of the needle lift h of the valve needle 3 independence on the time t are shown in corresponding FIGS. 5, 7, and 9 in which the respective positions of the valve needle 3 is marked on the needle lift-time curve by a rhombic symbol.

Figure 4:
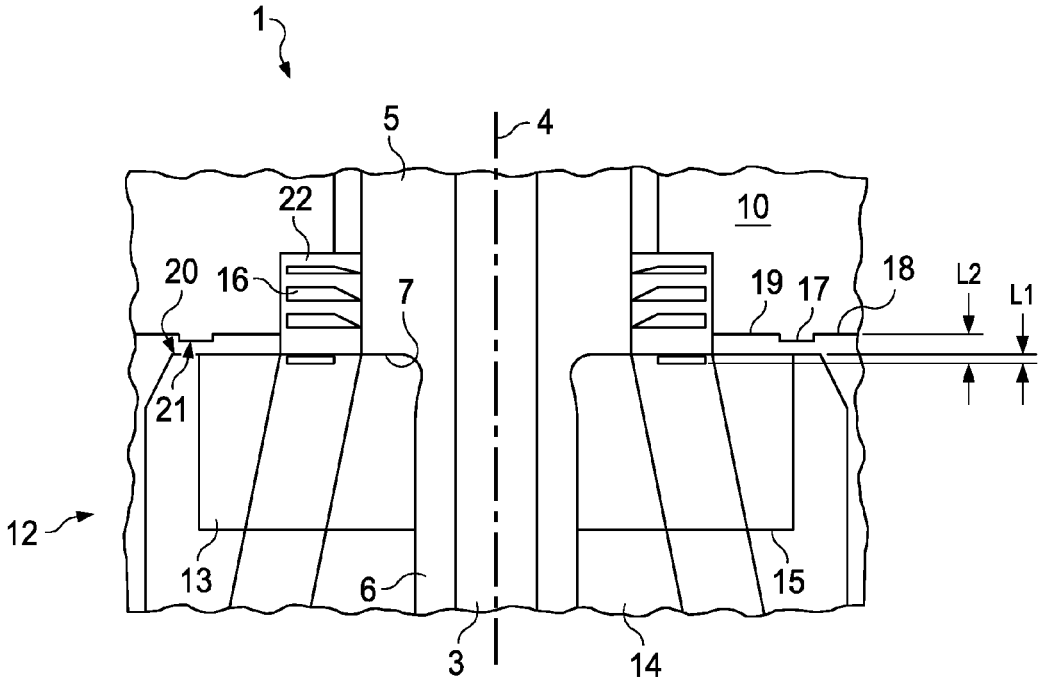
FIG. 4 is a longitudinal sectional view of a cut-out of the fuel injection valve of FIG. 1, wherein an armature has a first position.
Figure 5:
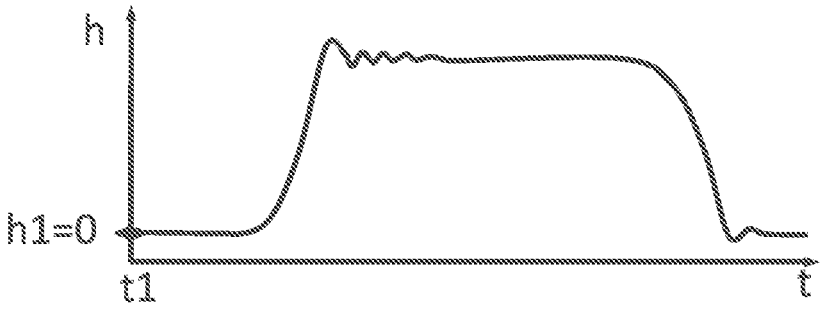
FIG. 5 is a diagram showing a lift of a valve needle of the fuel injection valve according to the first embodiment in dependence on time, with a first time marked which corresponds to the first position of the armature shown in FIG. 4.

FIG. 4 shows a closed configuration of the fuel injection valve. FIG. 4 is a longitudinal sectional view a cut-out of the fuel injection valve corresponding of FIG. 1. At this time t1 there is no movement of the valve needle 3 initiated, so that the lift h1 in the corresponding diagram of FIG. 5 has the value 0.

In the closed configuration, the magnetic coil 11 is de-energized and the valve needle 3 is pressed into its closing position to seal the nozzle orifice by means of the bias of the first spring element 8. The second spring element 16 presses the first armature part 13 into the first recess 15, away from the support area 7 and into contact with the second armature part 14 at the bottom of the first recess 15 so that the second armature part 14 is in turn pressed against the disc element 31.

In this way, a first gap S1 with a first gap height L1 is formed between the support area 7 and the first armature part 13. Further, a second gap S2 is formed between the pole element 10 and the first armature part 13. The height of the second gap has a value of L1+L2, wherein the height L2 corresponds to a maximum needle lift hmax of the valve needle 3.

For unsealing the nozzle orifice, the magnetic coil 11 is energized to generate a magnetic field for effecting an axial travel of the armature 12 towards the pole element 10.

By means of the magnetic field, both the first and second armature parts 13, 14 are attracted by the pole element 10. Thus, in a first period of the axial travel of the armaturer 12, the first and second armature parts 13, 14 are axially displaced relative to the valve needle 3—which remains in the closing position—and relative to the housing 2 towards the pole element 10 against the bias of the second spring element 16. By means of this bias, the form-fit coupling between the first and second armature parts 13, 14 is maintained throughout the first period of the axial travel.

Figure 6:
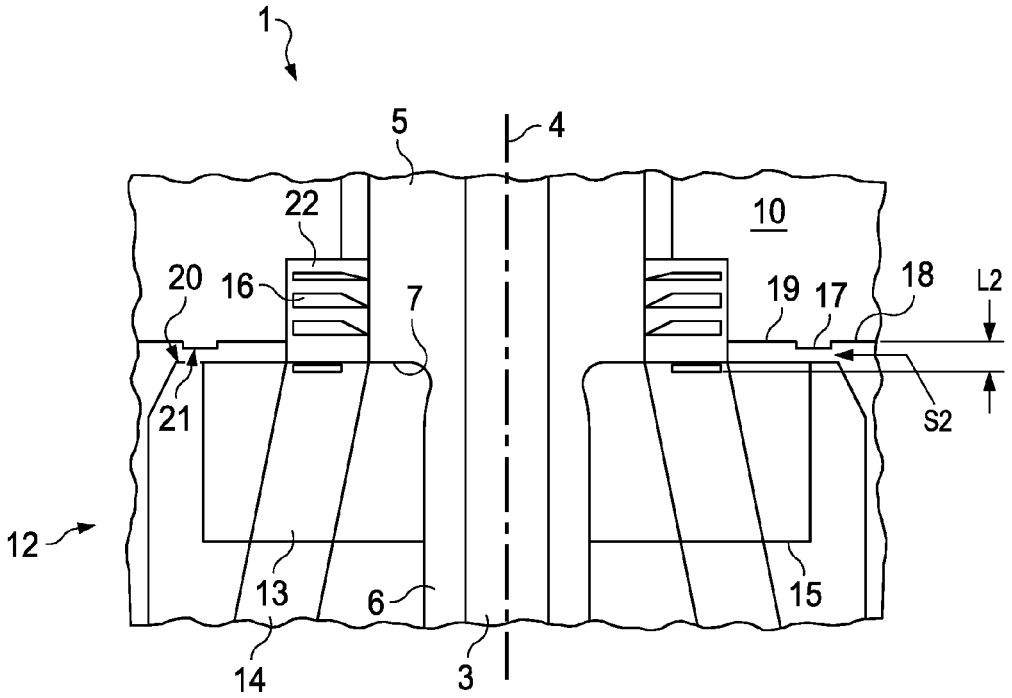
FIG. 6 is a longitudinal section view of a cut-out of the fuel injection valve corresponding to FIG. 1, wherein the armature is in a second position.
Figure 7:
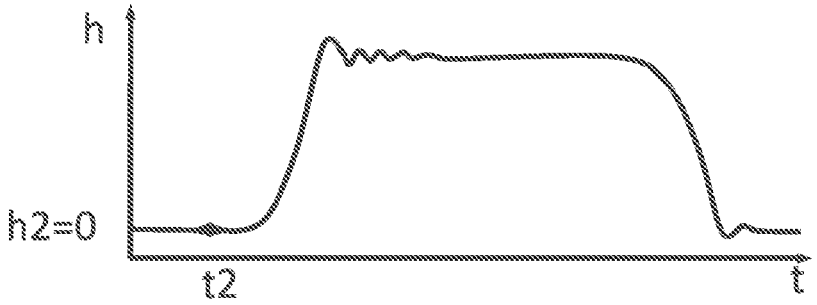
FIG. 7 is a lift-time diagram corresponding to that of FIG. 5, but with a second time marked which corresponds to the second position of the armature relating shown in FIG. 6.

The first period ends at a second time t2, when the first gap S1 is closed so that a form-fit connection is established between the support area 7 and the first armature part 13, see FIGS. 6 and 7. The second spring element 16 still maintains the contact between the first armature part 13 and the second armature part 14 so that at the second time t2, both the first and second armature parts 14 are in engagement with the valve needle for displacing the valve needle 3 away from the closing position. More specifically, the first armature part 13 is operable to transfer an axial force to the valve needle via the form-fit connection with the first valve needle portion 5 and the second armature part 14 is operable to transfer an axial force to the valve needle 3 my means of its form-fit connection with the first armature part 13.

Figure 8:
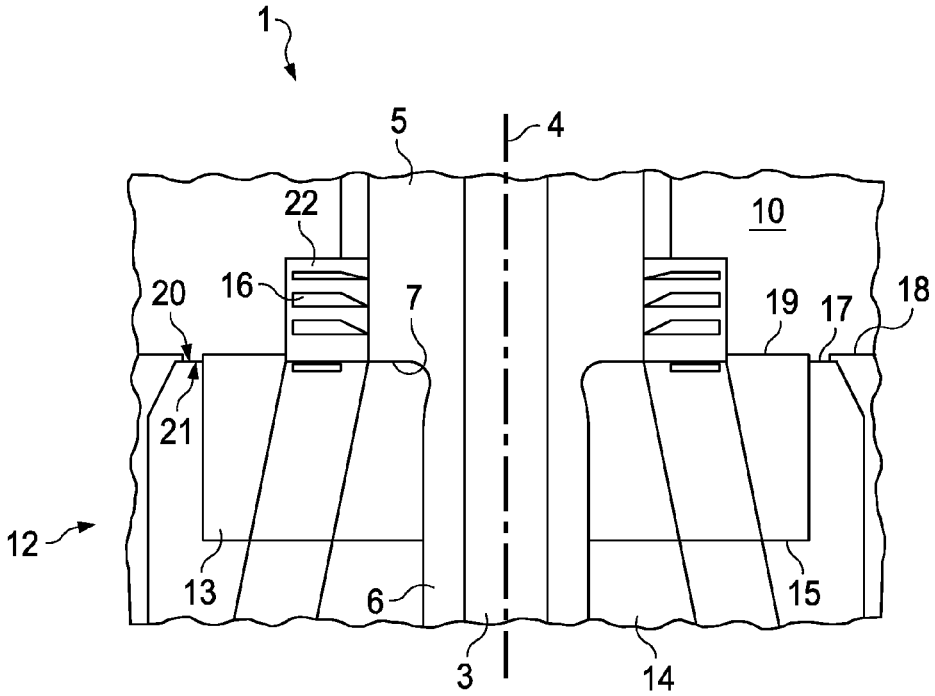
FIG. 8 is a longitudinal section view of a cut-out of the fuel injection valve corresponding to FIG. 1, wherein the armature is in a third position.
Figure 9:
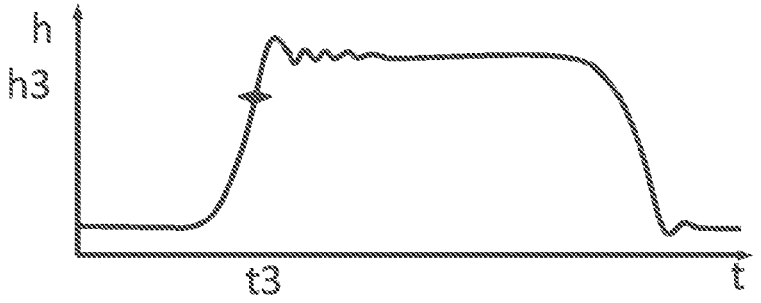
FIG. 9 is a lift-time diagram corresponding to that of FIG. 5, but with a third time marked which corresponds to the third position of the armature shown in FIG. 8.

At the time t2, the valve needle 3 is still not lifted. So the needle lift h2 at this time t2 has also the value 0. However, during a second period of the axial travel of the armature 12, following the first period and starting with the time t2, the valve needle 3 is axially displaced by the armature 12 to a position corresponding to a third needle lift h3 at the end of the second period; see FIG. 9. The corresponding position of the armature 12 and the valve needle 3 are represented in FIG. 8. During the second period, the first armature part 13 the second armature part 14 and the valve needle 3 are positionally fix to each other—by means of the form-fit connections between the valve needle 3 and the first armature part 13 and between the first and second armature parts 13, 14—and travel axially with respect to the housing 2.

At the end of the second period, the second armature part 14 comes into contact with a stopper provided on the pole element 10. When the contact between the second armature part 14 and the stopper 17 is made at a time t3, the lift h3 is reached.

The stopper 17 is provided between the pole element 10 and the armature 12. The stopper 17 is fixed to an end face 18 of the pole element 10, wherein the end face 18 is facing the armature 12, so that the axial movement of the second armature part 14 towards the pole element 10 is limited. The stopper 17 may be manufactured integrally with the pole element 10, i.e. in one piece with the pole element 10. Alternatively, the stopper 17 could also be manufactured as a single piece and could be fixed to the pole element 10 in a form-fit, force-fit or materially bounded way, so that the position of the stopper 17 at the pole element 10 is fixed.

The stopper 17 is annularly formed in this exemplary embodiment. It could as well have other shapes, for example square or elliptic. The stopper 17 could also be formed by sections, for example in form of segments by a circle.

The stopper 17 should only limit the movement of the second armature part 14, therefore it is provided in the area of the second armature part 14. With other words, the stopper 17 is fixed at the pole element 10 in this area, which is designed to be exclusively reached by the second armature pole 14. To put it differently, the stopper 17 laterally overlaps the second armature part 14. It exposes the first armature part in top view along the needle axis 4 so that the first armature part can axially overlap the stopper 17.

The lift h3 of the valve needle 3 is reached as soon as a second contact surface 21 of the second armature part 14 touches a first contact surface 20 of the stopper 17. The first contact surface 20 faces the second contact surface 21.

The first contact surface 20 has a smaller area than the second contact surface 21, so decoupling of the two surfaces will be faster than if they had an equal dimension.

The time t3 at which the second armature part 14 comes into contact with the stopper 17 corresponds to the end of the ballistic phase. From now on, a lower magnetic force is necessary for moving the valve needle 3 into the maximum lift hmax or to hold it in a corresponding position.

Figure 10:
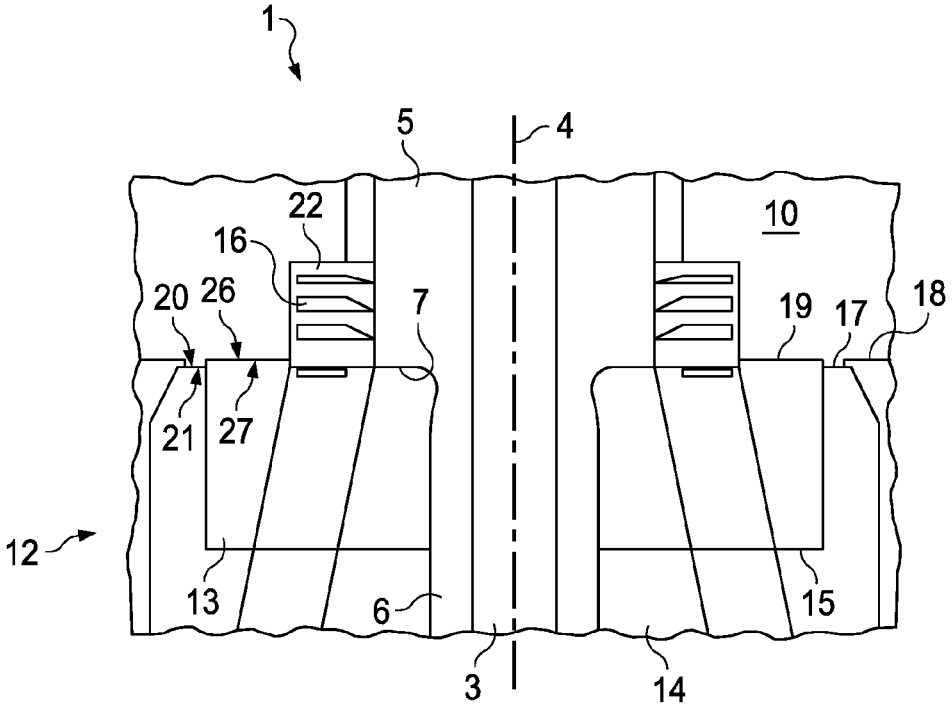
FIG. 10 is a longitudinal section view of a cut-out of the fuel injection valve corresponding to FIG. 1, wherein the armature is in a fourth position.

Consequently, during a third period of the axial travel of the armature 12, following the second period, only the first armature part 13 travels further towards the pole element 10 until it is stopped by coming in contact with the pole element 10, see FIG. 10.

Since the form-fit connection between the first and second armature parts 13, 14 is released at the end of the second period, only the first armature part 13 is operable, during the third period, to transfer an axially directed force to the valve needle 3 for moving the valve needle 3 further away from the closing position. Due to the force balance with the spring forces of the first and second spring elements 8, 16, velocity of the valve needle 3 may be reduced in the third period.

In one embodiment, the energisation of the magnetic coil 11 may be switched off during the third period. The then existing magnetic field and the inertia allows the further movement of the first armature part 13 for lifting the valve needle 3.

In order to enable further axial travel of the first armature part 13 when the second armature part 14 is already in contact with the stopper 17, a second recess 19 of the pole element 10 may be provided. The first armature part 13 may be partially arranged in the second recess 19 at least at the end of the third period of the axial travel of the armature 12. The recess 19 may expediently be defined by the stopper 17.

Ideally, the second recess 19 is complementarily formed to a surface contour of the first armature part 13. The second recess 19 provides a depth, which is deep enough so that based on the lift h3 the maximum lift hmax of the valve needle 3 is achieved.

In other words this means, decoupled from the second armature part 14, the first armature part 13 generates the force to lift the valve needle 3 based on the third lift h3 until the maximum lift hmax. The lift of the valve needle 3 or the movement of the valve needle 3 and the armature 12, respectively, are always axial movements along the valve needle axis 4, which corresponds to a fuel injection valve axis 25.

The axial travel of the first armature part 13 ends when a contact between a first contact area 26 of the pole element 10 and a second contact area 27 of the first armature part 13 is made.

For closing the fuel injection valve, the magnetic coil 11 is de-energized. The first armature part 13 is, thus, no longer held in contact with the pole element 10. Due to the force of the first spring element 8, the valve needle 3 will be urged against the nozzle orifice to close it, taking the first armature parts 13 with it, away from the pole element 10, by means of the form-fit coupling at the support area 7. The first armature part 13 is also biased in the same direction by the second spring element 16.

When the valve needle has reached the position h3, the first and second armature parts 13, 14 enter into form-fit engagement at the bottom of the first recess 15, again. Subsequently, both move axially away from the pole element 10 together with the valve needle 3.

When the valve needle 3 reaches the closing position, it stops and the form-fit engagement with the first armature part 13 is release. Driven by the second spring element 16, the first and second armature parts 13, 14 continue moving away from the pole element 10 when the valve needle 3 has reached the closing position until the second armature part hits the disc element 31 and the initial closing configuration is restored.

Figure 11:
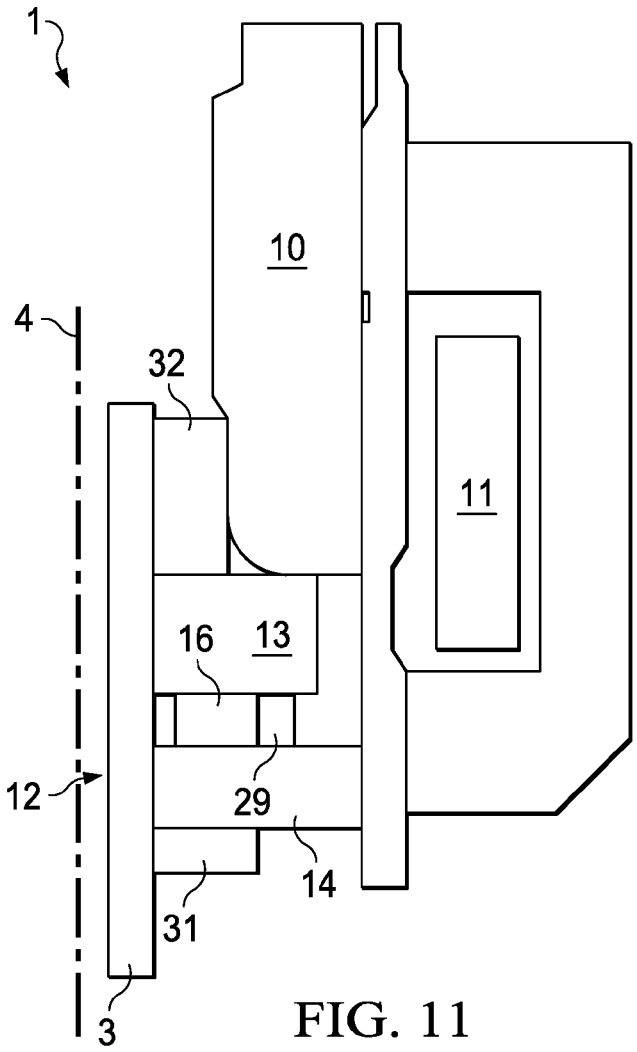
FIG. 11 is a schematic longitudinal section view of a second exemplary embodiment of the fuel injection valve.

FIG. 11 shows a second exemplary embodiment of the fuel injection valve in a schematic longitudinal section view of a portion of the valve. FIGS. 13 to 16 show the fuel injection valve according to the second exemplary embodiment in schematic longitudinal section views in various stages of one injection event. For the sake of simplicity, only the portion of the valve on the right-hand side of the needle axis 4 is depicted in these figures.

In contrast to the first embodiment, the second spring element 16 is positioned between the first and second armature parts 13, 14 in the second embodiment. The second spring element 16, which is a wave spring, is accommodated in a fourth recess 29 of the second armature part 14. The fourth recess 29 extends axially into the second armature part 14 from the bottom of the first recess 15 in which the first armature part 13 is received. The fourth recess 29 could alternatively be provided in the first armature part 13.

In the closed configuration (see FIG. 13), the second spring 16 biases the first and second armature parts 13, 14 axially away from one another so that the first armature part 13 abuts the support area 7 of the first valve needle portion 5 and the second armature part 14 is in contact with the disc element 31. In this way, a first gap S1 is established between the first and second armature parts 13, 14. The first gap has a height L1, corresponding to a free lift of the second armature part 14. The first armature part 13 could be fixed or not to the valve needle 3, in particular to the needle retainer 32.

The hydraulic load, created by the fuel, and the spring load of the first spring element 8 only act on the valve needle 3 and the first armature part 13 to hold the valve needle 3 in the closing position.

Figure 14:
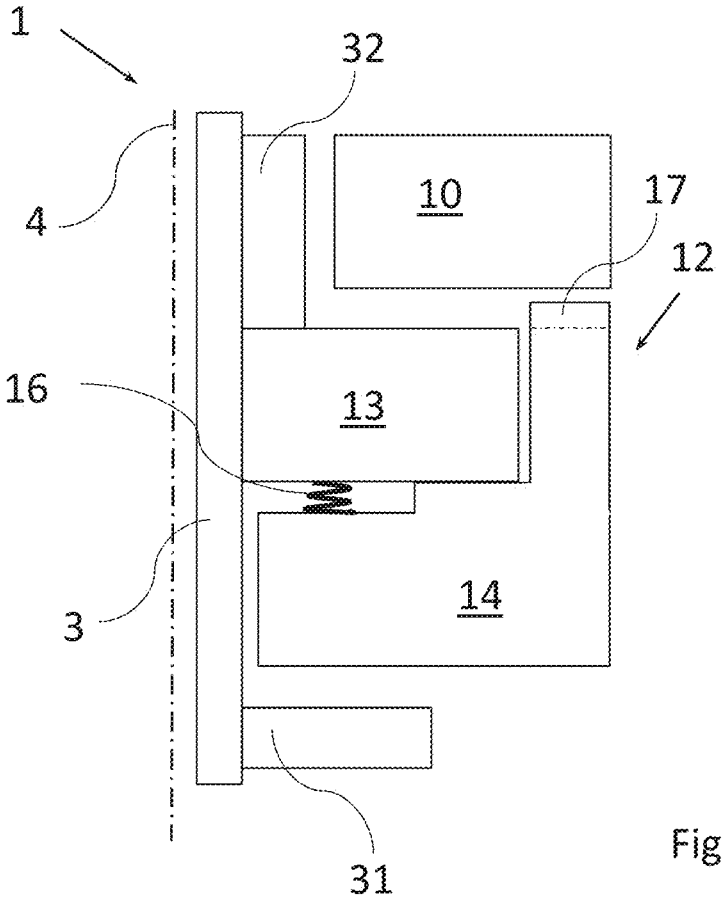
FIG. 14 is a schematic longitudinal section view of the fuel injection valve relating to FIG. 11, the armature in a position at the second time.
Figure 15:
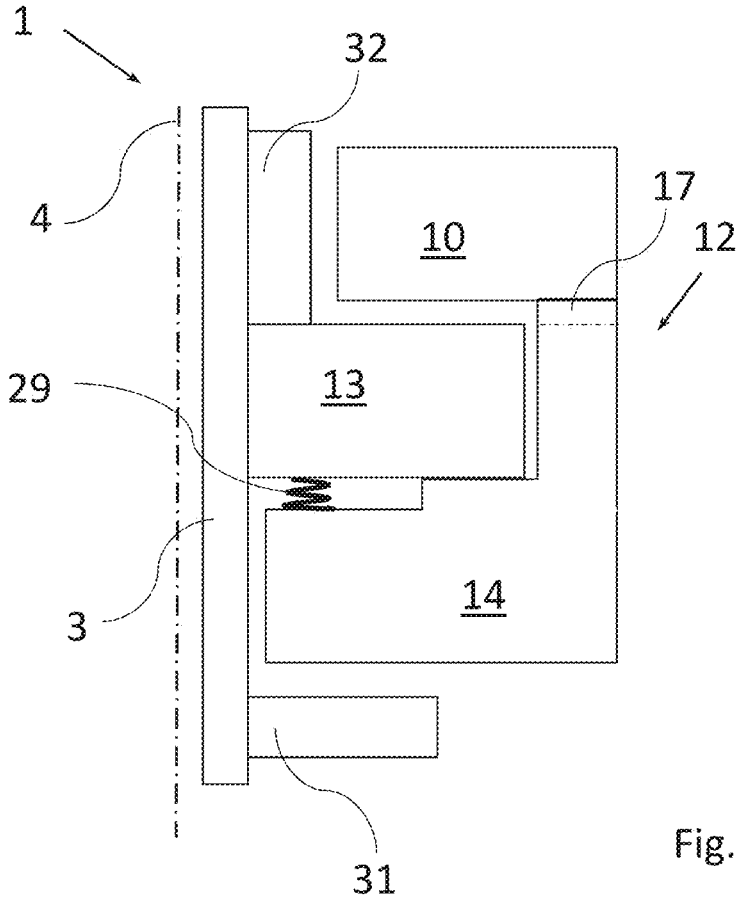
FIG. 15 is a schematic longitudinal section view of the fuel injection valve relating to FIG. 11, the armature in a position at the third time.
Figure 16:
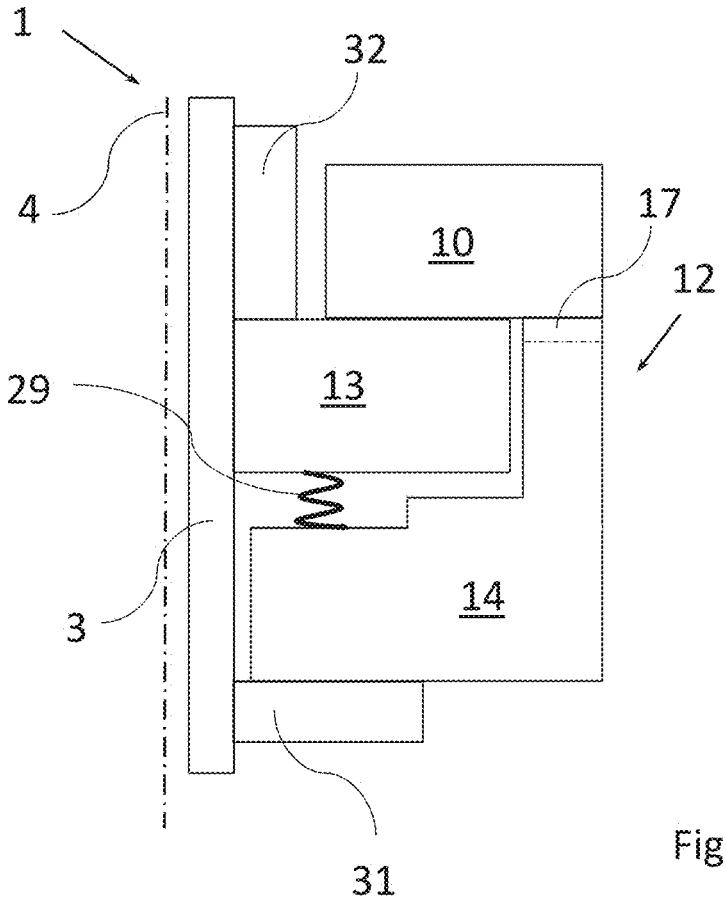
FIG. 16 is a schematic longitudinal section view of the fuel injection valve relating to FIG. 11, the armature in a position at the fourth time.

When the magnetic field is created by energizing the magnetic coil 11, during the first period of the axial travel of the armature 12, the magnetic force pulls up the second armature part 14 towards the pole element 10 against the spring force of the second spring element 16 until the second armature part 14 touches the first armature part 13, see FIG. 14. Now the first armature part 13 and the second armature part 14 are in contact at the end of the first period. The first gap S1 with its first gap height L1 is closed. This means, that a so-called free lift is travelled. The free lift describes the lift, which has to be done by the second armature part 14 without lifting the valve needle 3.

In contrast to the first embodiment, the first armature part 13 does not move during the first period. The bias of the first spring element 8 and the hydraulic force on the valve needle 3 retain the valve needle 3 with the first armature part 13 at rest in the closing position against the magnetic force acting on the first armature part 13 in the first period.

After the impact between the first armature part 13 and the second armature part 14, both the first armature part 13 and the second armature part 14 act on the valve needle 3 during the second period. The magnetic force, which initiates the lift of the valve needle 3 in the second period and therefore the opening of the nozzle orifice, is the sum of the magnetic force on the first armature part 13 and the second armature part 14. It is large enough to overcome the spring force of the first spring element 8 and the hydraulic load on the valve needle 3.

The valve needle 3, the first armature part 13 and the second armature part 14 travel together towards the pole element 10 and remain positionally fix with respect to one another during the second period. At the end of the second period, is stopped by means of interaction with the pole element 10 via a stopper 17, see FIG. 15. In the present embodiment, the stopper 17 between the pole element 10 and the second armature part 14 is represented by a top portion of the second armature part 14 which faces towards the pole element 10. The top portion in particular protrudes axially beyond the first armature part 13 when the latter abuts the bottom of the first recess 15 of the second armature part 14 in which it is arranged. Contrary to the first embodiment, the stopper is not fixed to the pole element 10 but to the second armature part 14 in the present embodiment.

When the second armature part 14 is stopped at the pole element 10, the magnetic force of the second armature part 14 is no more acting on the valve needle 3. Therefore the second armature part 14 doesn't contribute anything to lift the valve needle 3 during the subsequent third period. The full needle lift L2 of the valve needle 3 during the opening of the nozzle orifice is reached when the first armature part 13 bounces against the pole element 10 at the end of the third period, see FIG. 16.

Figure 12:
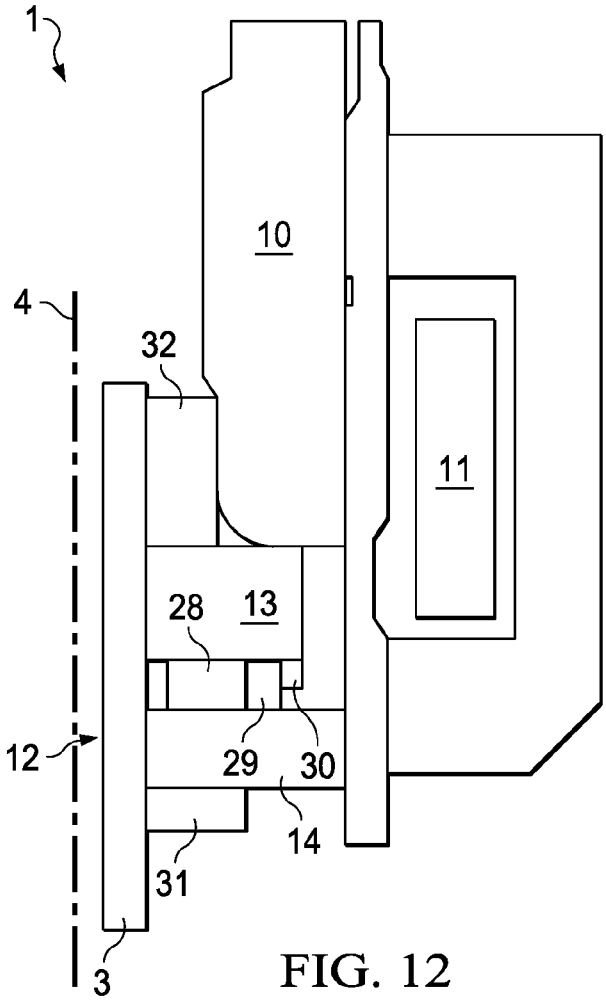
FIG. 12 is a schematic longitudinal section view of a third exemplary embodiment of the fuel injection valve.
Figure 13:
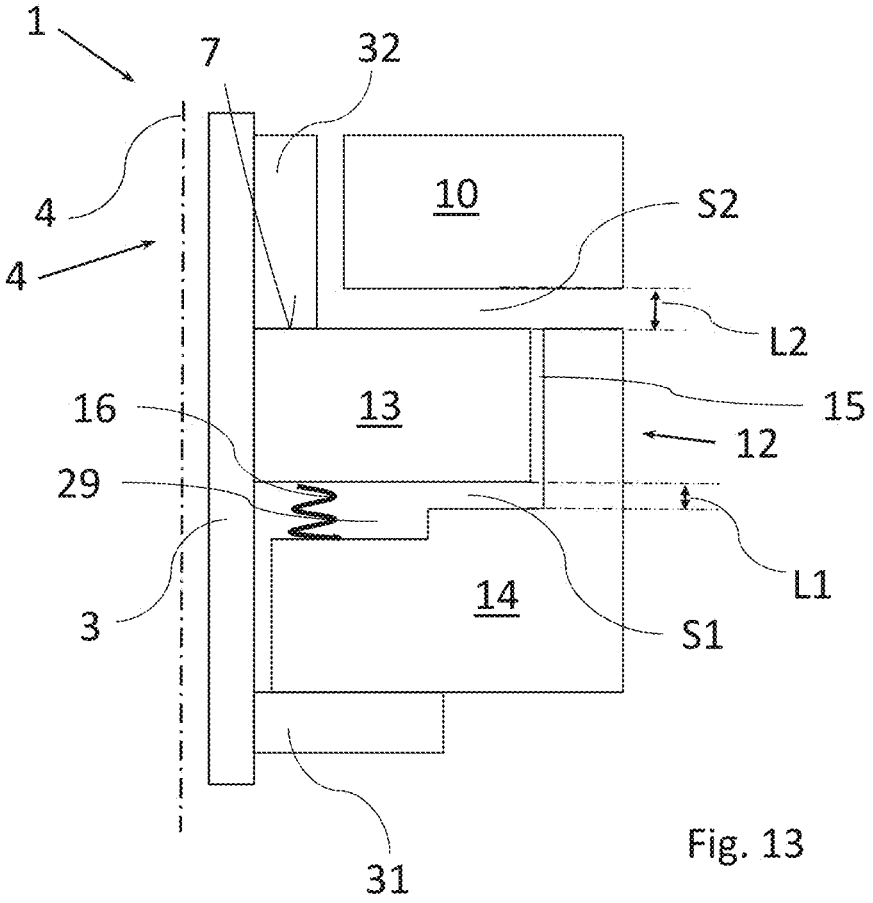
FIG. 13 is a schematic longitudinal section view of the fuel injection valve relating to FIG. 11, the armature in a position at the first time.

FIG. 12 shows a third exemplary embodiment of the fuel injection valve in a schematic longitudinal section view of a cut-out of the valve. The fuel injection valve 1 according to the third exemplary embodiment corresponds in general to that of the second exemplary embodiment.

However, according to the third embodiment, a non-magnetic element 30 is positioned between the first armature part 13 and the second armature part 14. The non-magnetic element 30 in particular protrudes from the bottom of the first recess 15 of the second armature part 14 axially towards the first armature part 13. In this way, the risk of sticking between the two armature parts due to magnetic remanescence is particularly small.

The non-magnetic element 30 is shaped as a ring. It could as well have other shapes, for example square or elliptic. The non-magnetic mean 30 could also be formed by sections, for example in form of segments by a circle.

What is claimed is:

1. A fuel injection valve for an internal combustion engine, comprising:

a housing, a valve needle with a needle axis being movably positioned in the housing, a first spring element that biases the valve needle towards a closing position for sealing a nozzle orifice of the fuel injection valve, a movable armature that is movable along the needle axis and operable to interact with the valve needle for displacing the valve needle away from the closing position against the bias of the first spring element, wherein the armature comprises a first armature part and a second armature part, wherein the first armature part and the second armature part laterally enclose the valve needle at least in places, a pole element that is immovably arranged in the housing and which is operable to limit movement of the armature, and a magnetic coil at least partially enclosing the housing and operable to generate a magnetic field for effecting an axial travel of the armature towards the pole element for displacing the valve needle away from the closing position, wherein, during a first period of the axial travel, at least the second armature part is axially displaced with respect to the valve needle while the valve needle remains in the closing position, the axial displacement being limited so that the second armature part is operable to engage with the valve needle at an end of the first period for displacing the valve needle away from the closing position, wherein during a subsequent second period of the axial travel, the first armature part, the second armature part and the valve needle are positionally fix with respect to each other and travel axially with respect to the housing (2), and wherein the axial travel of the second armature part is stopped at an end of the second period by means of interaction with the pole element, such that during a subsequent third period of the travel, only the first armature part travels further towards the pole element for moving the valve needle further away from the closing position and the axial travel of the first armature part is subsequently stopped at an end of the third period by means of interaction with the pole element.

2. The fuel injection valve of claim 1, wherein the first armature part is rigidly fixed to the valve needle or defines a form-fit engagement with the valve needle at least during the second and third period of the axial travel of the armature.

3. The fuel injection valve of claim 1, wherein a stopper is provided between the pole element and the armature for stopping the axial travel of the second armature part at the end of the second period of the travel of the armature.

4. The fuel injection valve of claim 3, wherein the stopper is annularly shaped and surrounds the first armature part.

5. The fuel injection valve of claim 3, wherein the stopper has a first contact surface of which faces toward the armature, and the second armature part has a second contact surface which faces toward the first contact surface and is in contact with the first contact surface when the stopper stops the axial travel of the second armature part, the first contact surface having a smaller area than the second contact surface.

6. The fuel injection valve of claim 1, wherein the pole element comprises a recess for accommodating at least a portion of the first armature part.

7. The fuel injection valve of claim 1, wherein the valve needle is formed with a constriction.

8. The fuel injection valve of claim 1, wherein one of the armature parts is accommodated in a recess which is provided in the other armature part.

9. The fuel injection valve of claim 1, wherein a second spring element is provided in the housing for biasing the second armature part away from the pole element.

10. The fuel injection valve of claim 9, wherein the second spring element is positioned between the armature and the pole element.

11. The fuel injection valve of claim 9, wherein the pole element comprises a recess that receives the second spring element.

12. The fuel injection valve of claim 9, wherein the second spring element is positioned between the first armature part and the second armature part.

13. The fuel injection valve of claim 12, wherein the second spring element is received in a recess which is provided in the first armature part or the second armature part.

14. The fuel injection valve of claim 9, wherein the second spring element is an undulated washer or a wave spring.

15. The fuel injection valve of claim 12, comprising a non-magnetic element between the first armature part and the second armature part.

16. The fuel injection valve of claim 15, wherein the non-magnetic element comprises a non-magnetic ring.

17. An internal combustion engine, comprising:

a plurality of fuel injection valves, each comprising:

a housing, a valve needle with a needle axis being movably positioned in the housing, a first spring element that biases the valve needle towards a closing position for sealing a nozzle orifice of the fuel injection valve, a movable armature that is movable along the needle axis and operable to interact with the valve needle for displacing the valve needle away from the closing position against the bias of the first spring element, wherein the armature comprises a first armature part and a second armature part, wherein the first armature part and the second armature part laterally enclose the valve needle at least in places, a pole element that is immovably arranged in the housing and which is operable to limit the movement of the armature, and a magnetic coil at least partially enclosing the housing and operable to generate a magnetic field for effecting an axial travel of the armature towards the pole element for displacing the valve needle away from the closing position, wherein, during a first period of the axial travel, at least the second armature part is axially displaced with respect to the valve needle while the valve needle remains in the closing position, the axial displacement being limited so that the second armature part is operable to engage with the valve needle at an end of the first period for displacing the valve needle away from the closing position, wherein during a subsequent second period of the axial travel, the first armature part, the second armature part and the valve needle are positionally fix with respect to each other and travel axially with respect to the housing (2), and wherein the axial travel of the second armature part is stopped at an end of the second period by means of interaction with the pole element, such that during a subsequent third period of the travel, only the first armature part travels further towards the pole element for moving the valve needle further away from the closing position and the axial travel of the first armature part is subsequently stopped at an end of the third period by means of interaction with the pole element.

* * * * *